US005417301A

United States Patent [19]

Wildner

[11] Patent Number: 5,417,301

[45] Date of Patent: May 23, 1995

[54] ENVIRONMENTALLY SAFE WORK PLATFORM

[75] Inventor: Robert J. Wildner, R.D. 2 Box 347A, Johnstown, Pa. 15904

[73] Assignee: Robert J. Wildner, Johnstown, Pa.

[21] Appl. No.: 172,925

[22] Filed: Dec. 27, 1993

[51] Int. Cl.[6] ..... E04G 3/10

[52] U.S. Cl. ..... 182/63; 182/138

[58] Field of Search ..... 182/150, 142, 129, 63, 182/37, 36, 138

[56] References Cited

U.S. PATENT DOCUMENTS

| | | | |
|---|---|---|---|
| 3,076,522 | 2/1963 | Goodell . | |
| 4,429,764 | 2/1984 | Parli | 182/129 |
| 4,660,680 | 4/1987 | Potin . | |
| 4,848,516 | 7/1989 | Nakai et al. . | |
| 4,852,307 | 8/1989 | Goudeau . | |
| 5,007,501 | 4/1991 | Baston | 182/142 X |
| 5,011,710 | 4/1991 | Harrison . | |
| 5,065,838 | 11/1991 | Finley | 182/142 X |
| 5,203,428 | 4/1993 | Beeche . | |
| 5,299,655 | 4/1994 | Margaritis | 182/150 X |

FOREIGN PATENT DOCUMENTS

| | | | |
|---|---|---|---|
| 862165 | 1/1953 | Germany | 182/37 |

OTHER PUBLICATIONS

Product Brochure of Swing-Lo Suspended Scaffold Co., Inc. of Covert, Mich., dated Nov. 1987.

*Primary Examiner*—Alvin C. Chin-Shue

*Attorney, Agent, or Firm*—Banner, Birch, McKie & Beckett

[57] ABSTRACT

A worker platform assembly is modular in construction so as to be configurable according to the configuration and size, particularly width, requirements of each bridge and to metal surfaces thereof which are to be reconditioned by abrasive stripping and recoating. The assembled platform is suspendable at each end by suspension frame assemblies which are rollable along the parapets of the bridge for repositioning the platform assembly, with the suspension assembly being adjustable to various configurations of parapets. An adjustable curtain frame enables sealed enclosure of bridge surfaces to be treated and optimum access of workers to those surfaces during the treatment. Airborne residue is evacuated by vacuum for subsequent disposal in a manner which does not contaminate the environment, while heavier residue and spent abrasive grit is collected and positively moved off of the platform assembly for subsequent, environmentally safe separation and reconstitution of the grit for reuse.

35 Claims, 17 Drawing Sheets

ENVIRONMENTALLY SAFE WORK PLATFORM

PRIOR ART CROSS REFERENCES

U.S. Pat. No. 3,076,522 to GOODELL, issued Feb. 5, 1963, entitled Bridge Scaffold Apparatus.

U.S. Pat. No. 4,660,680 to POTIN, issued Apr. 28, 1987, entitled Means and Methods for Erecting a Work Platform Under the Deck of a Structure.

U.S. Pat. No. 4,848,516 to NAKAI et al., issued Jul. 18, 1989, entitled Movable Scaffold.

U.S. Pat. No. 4,852,307 to GOUDEAU, issued Aug. 1, 1989, entitled System for Retrieving Sandblasted Cuttings.

U.S. Pat. No. 5,011,710 to HARRISON, issued Apr. 30, 1991, entitled Bridge Maintenance Method and Equipment.

U.S. Pat. No. 5,203,428 to BEECHE, issued Apr. 20, 1993, entitled Modular Scaffolding Platform and Truss Frame Components Therefor.

Product Brochure of Swing-Lo Suspended Scaffold Co., Inc. of Covert, Mich. dated November 1987.

BACKGROUND OF THE INVENTION

The invention is in the field of maintenance of steel bridge supports and the like and is directed to platforms from which workers can treat steel surfaces on the undersides and tops of the bridges, particularly during removal of rust and paint by blasting the metal surfaces with particles.

OSHA regulations provide stringent requirements for containment of any debris resulting from such treatment and capable of contaminating the surrounding environment, both during and after the treatment. From an economic standpoint, it is preferable to collect, clean and reuse the particles used in abrasive blasting.

Thus, an object of the invention is to provide an apparatus upon which workers are supported so that they can stand and walk to address the metal surfaces to be stripped and recoated, while improving upon previous attempts at containing and collecting the contaminating airborne debris and heavier, spent particles in a manner which is safe for the environment.

Another object of the invention is to provide an improved work platform with frames and curtains for enclosing metal bridge surfaces that are to be blasted with the abrasive particles.

It also is an object of the invention to provide for suspension of such a work platform from the bridge such that positioning and repositioning of the platform relative to the work is facilitated.

Still another object of the invention is to provide that the work platform includes a hopper for collecting used abrasive grit and a mechanical conveyor for positively driving the used grit out of the hopper in order to evacuate the grit for decontamination and recycling thereof while preventing overloading of the platform and supporting structure.

Additionally, it is an object of the invention to provide that the auger assembly is accessible from within the enclosed, suspended platform for purposes of replacement, repair, or what have you.

These and various other novel features of the invention will become more apparent from the following disclosure.

SUMMARY OF THE INVENTION

A worker platform assembly is modular in structure so as to be configurable according to the configuration and size, particularly width, requirements of each bridge and to metal surfaces thereof which are to be reconditioned by abrasive stripping and recoating. The assembled platform is suspendable at each end by suspension frame assemblies which are rollable along the parapets of the bridge for repositioning the platform assembly, with the suspension assembly being adjustable to various configurations of parapets. An adjustable curtain frame enables sealed enclosure of bridge surfaces to be treated and optimum access of workers to those surfaces during the treatment. Airborne residue is evacuated by vacuum for subsequent disposal in a manner which does not contaminate the environment, while heavier residue and spent abrasive grit is collected and positively moved off of the platform assembly for subsequent, environmentally safe separation and reconstitution of the grit for reuse.

DETAILED DESCRIPTION OF THE INVENTION

Figure 1:
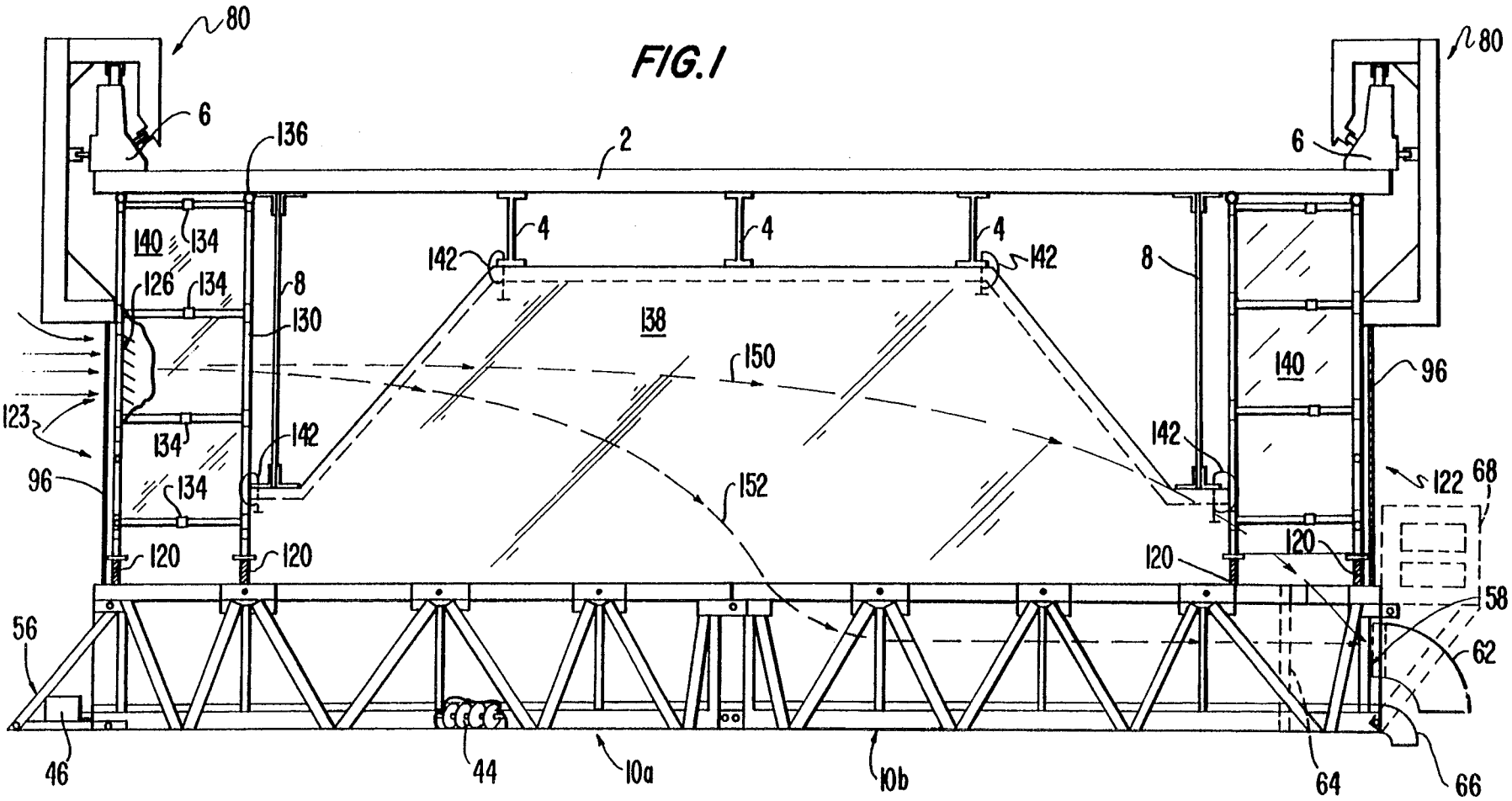
FIG. 1 is an elevational view of the apparatus of the invention in operational, suspended position beneath a bridge.

Referring to FIG. 1, a conventional bridge is illustrated in cross-section as having a roadway deck 2, New Jersey wall-type parapets 6, inner I-beams 4, and outer I-beams 8 having substantially deeper web portions than I-beams 4. A work enclosing platform assembly is shown suspended below the bridge from rolling suspension frames 80 via suspension cables 96, as will be described in greater detail with reference to FIGS. 17–25. FIG. 1 depicts seen two "series" or end-to-end connected modules 10*a* and 10*b* spanning the width of the bridge sufficiently to allow enclosure of, and access to, the outer portions of I-beams 8.

Figure 6:
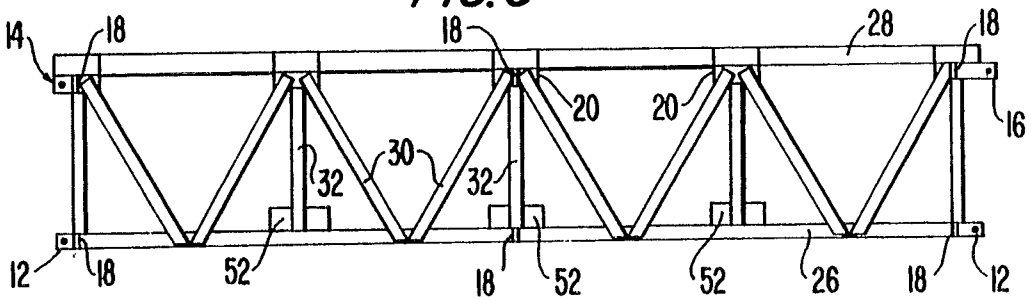
FIG. 6 is an elevational view of the basic platform module.

With reference to FIGS. 6–11, each module 10 comprises a side truss structure extending lengthwise and along each side. As seen in FIG. 6, each such side truss has a top chord 28 and bottom chord 26. As seen in the cross-sectional view of FIG. 11, top chord 28 is made up of two C-beams which are spaced apart, back-to-back, by gussets 20 which also provide points of attachment between the C-beams at several locations along the length of the chord 28; and lower chord 26 is a T-beam. L-beams 32 extend vertically between top chord 28 and bottom chord 26, with L-beams 30 extending diagonally, as seen in FIG. 6.

Figure 11:
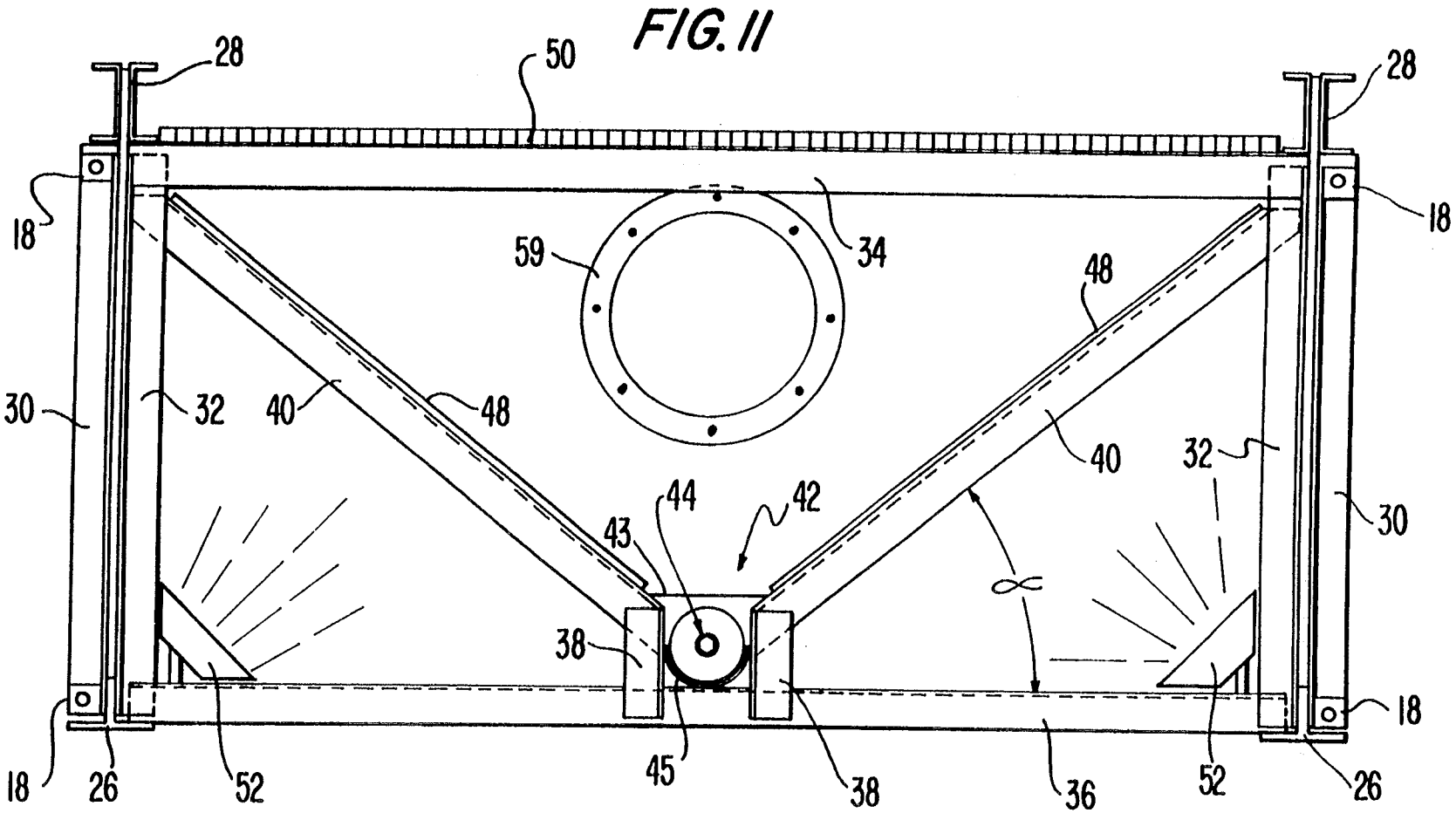
FIG. 11 is a cross-section of FIG. 6, as viewed generally in the direction of arrows 11—11.

Referring to FIG. 11, each module 10 also has upper lateral L-beams 34 and lower lateral L-beams 36 extending between the side truss structures. Beams 34 and 36, in combination with the short center posts 38 and lateral diagonal beams 40, provide a lateral truss structure which is oriented perpendicular to the planes of the side truss structures.

Figure 15:
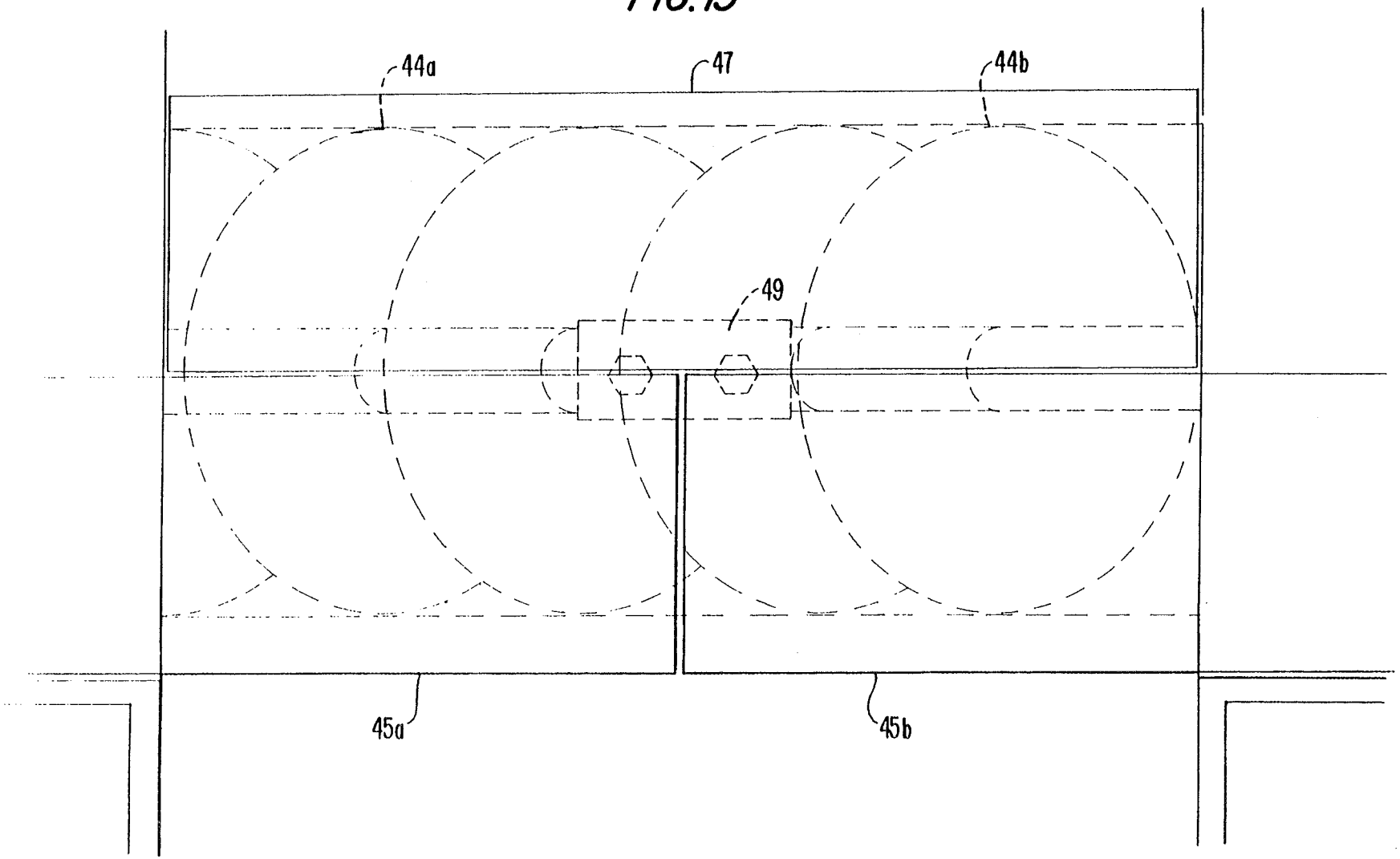
FIG. 15 is a partial elevational view depicting the connection and cover for the augers of series connected modules.

Situated between posts 38 is the housing 42 for an auger 44 which extends the full length of the module 10. In a prototype of the invention, housing portion 45 is made of 6″ diameter, schedule 40 PVC which is halved lengthwise. As seen in FIG. 11, an aluminum screen 43 spans the bottom of the trough to provide support for a worker to stand in the trough while working on the auger assembly or the like. The openings of screen 43 are sized for efficient passage of the particulate material therethrough to the auger 44. FIG. 15 depicts a shroud for preventing contamination of the environment at the end-to-end connection of a pair of augers 44*a* and 44*b*. Specifically, an additional piece 47 of the schedule 40 PVC is sized to cover the abutting portions 45*a* and 45*b* which extend past the respective end panels of series connected modules. A connecting sleeve 49 surrounds and is bolted to the abutting cores of augers 44*a* and 44*b*. A rubber boot (which, for clarity, is not shown) is used to cover the entire joint, with a pair of stainless steel straps (also not shown) maintaining the integrity of the shroud.

Panels 48 are mounted on lateral diagonals 40 so as to form the sides of a trough structure for directing particulate down to auger 44. Preferably, the sides of the trough are angled such that $\alpha=39°$. This value of $\alpha$ has been selected in order to ensure settling of the larger particles of abrasive grit, down the sides of the trough to the auger 44, and to facilitate situation of exhaust port 58 below worker supporting grate 50 and auger 44 for vacuum evacuation of lighter, airborne dust and debris separate from the larger particles, as will be explained in greater detail with reference to FIG. 1.

Panels 48 may be transparent or translucent. Preferably, panels 48 are translucent so as to diffuse light directed into the enclosure from fixtures 52 while illuminating the inside of the enclosure sufficiently for working in an otherwise low-light or no-light situation. By mounting fixtures 52 on the truss frame of module 10, outside of the collection trough and the rest of the enclosure, a requirement and added expense of explosion-proof lighting is obviated.

Figure 8:
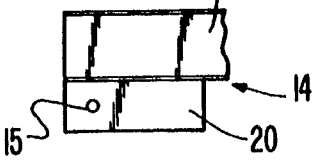
FIG. 8 is a partial elevation of a so-called flush connection point for the top chord.
Figure 10:
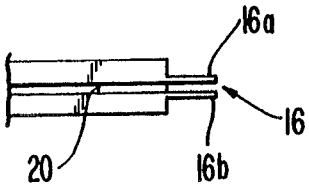
FIG. 10 is a top plan view of FIG. 9.
Figure 9:
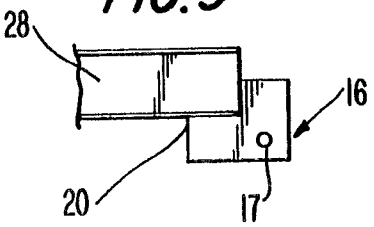
FIG. 9 is a partial elevation of a so-called protruding connection point for the top chord.

Referring particularly to FIGS. 6–10, each top chord 28 has a "protruding connection point" 16 on one end thereof and a "flush connection point" 14 on the other end thereof. The flush connection point 14 comprises a hole 15 in an end gusset plate 20, as best seen in FIG. 8. The protruding connection point 16 is provided by plates 16*a* and 16*b* which have hole 17 and are attached on each side of the other end gusset 20. Thus, when connecting top chords 28 in series or end-to-end, gusset 20 of flush connection 14 fits between plates 16*a* and 16*b* of protruding connection point 16 whereby holes 15 and 17 are aligned for reception of a pin (not shown) so as to complete the connection.

Figure 13:
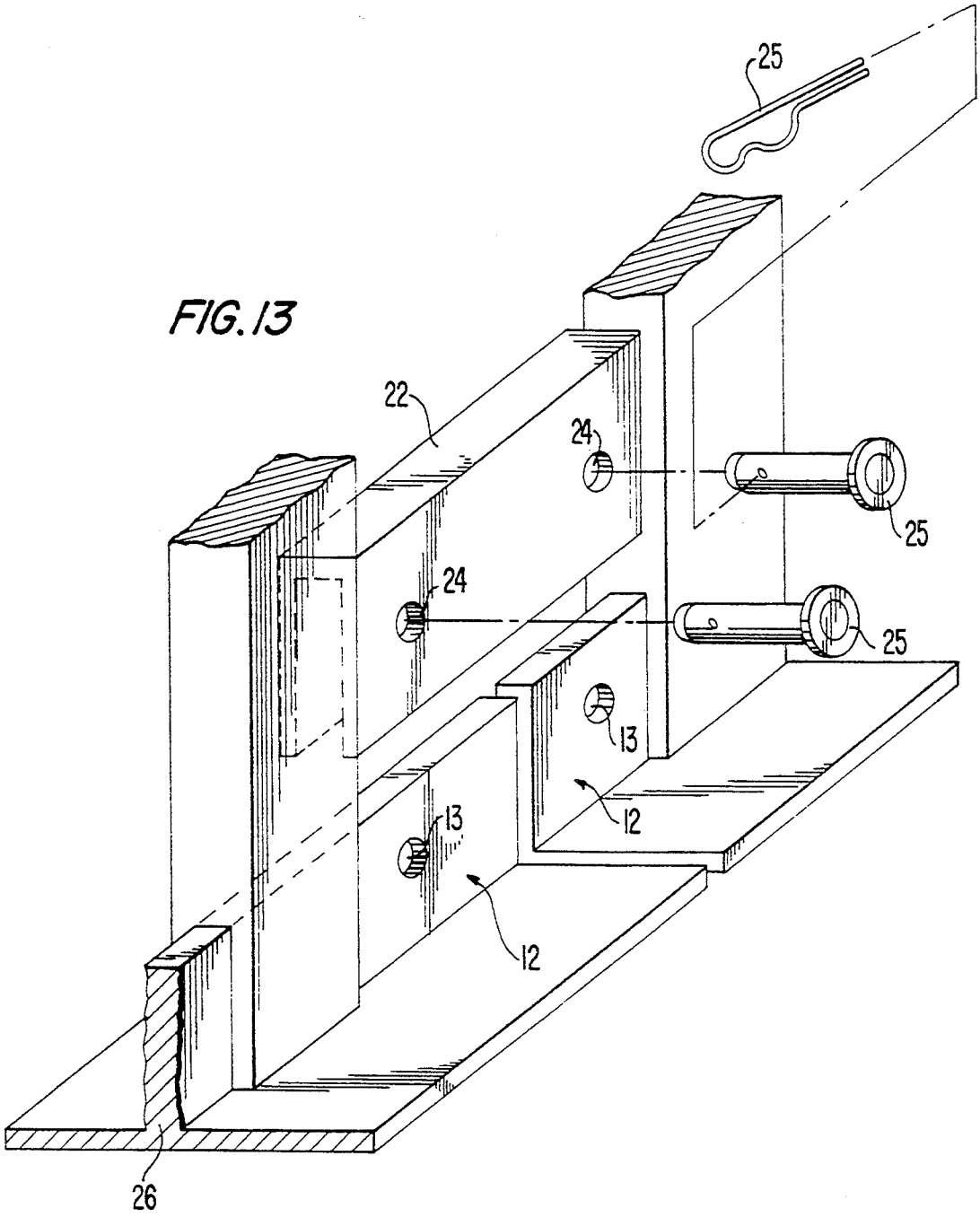
FIG. 13 is a perspective, partially exploded view of the special connection of two bottom chords end-to-end.

With particular reference to FIGS. 6 and 13, each end of bottom chord 26 has a hole 13 so that inverted U-shaped connector 22 may receive vertically protruding portions of end-to-end bottom chords such that holes 24 of connector 22 align with holes 13 of the abutted bottom chords 26. Pins or bolts 25 are inserted into the aligned holes, and hairpin spring clips 25′ or the like are use to complete the connection. In general, unless otherwise noted, pins 25 and clips 25′ or the like are used at all connection points on the platform assembly which require a specific means of retention.

Sufficient camber is introduced into the top and bottom chords 26,28 of each module so that, upon connecting two modules end-to-end, the cambered longitudinal chords of the overall platform assembly will straighten under maximum loading of 30 lb./ft$^2$. Because of the camber introduced into the longitudinal top and bottom chords, the end-to-end connection for the chords must accommodate assembling of serially arranged modules that are unloaded or unstressed, and also provide a reliable connection when the overall platform assembly is under maximum stress.

Such accommodation is provided for the upper chord connections by placing holes 15 and 17 such that a slight gap will remain between the ends of series connected top chords 28 when fully loaded or stressed to a straightened condition. Such a slight gap will allow connection of top chords end-to-end when they are unloaded and, thus, not face-to-face parallel at the so-called abutting ends.

For the lower chords, such an accommodation is provided by connector 22. The holes 24 thereof are sized slightly larger than holes 13 of lower chords 26 and are spaced appropriately from the top of connector 22 (as viewed in FIG. 13) so as to accommodate non-parallelism of the faces of the so-called abutting ends of bottom chords 26 when in an unloaded or unstressed condition. It also is provided that the vertically protruding portion of the lower chords 26 engage and abut the inside surface of the top portion of connector 22 when fully stressed or loaded to a straightened or uncambered condition of the chords 26.

Figure 12:
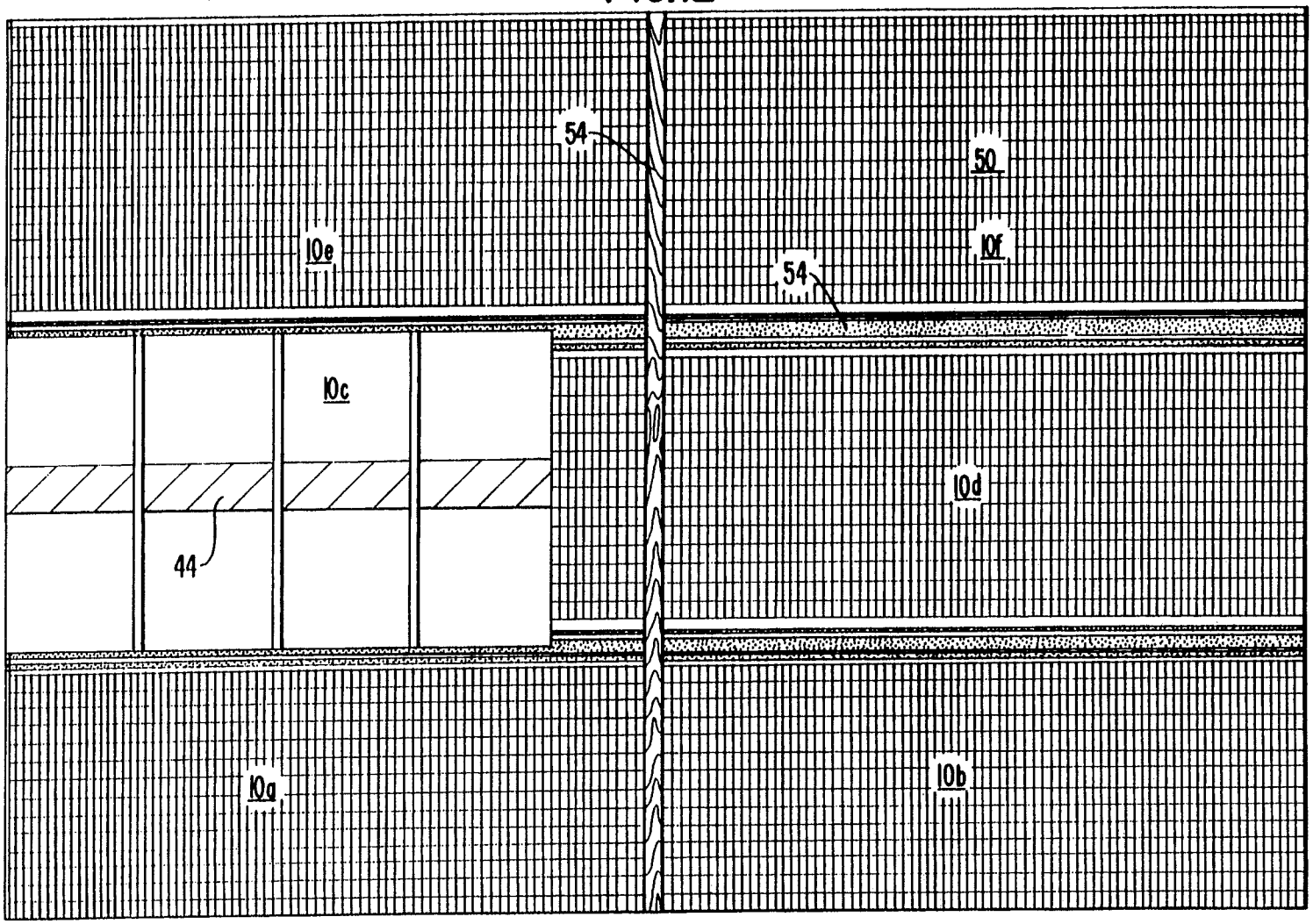
FIG. 12 is a top plan view of six modules and illustrates the series and parallel arrangement of them into one larger platform.

The particular relationship between modules making up the platform assembly of FIGS. 1–5 is best understood by referring to FIG. 12. Each end-to-end pair of modules is pinned together at bottom points 12 and top points 14,16. Each such pair of end-to-end modules also is connected to each adjoining other pair of modules by pinning at side connection points 18 (FIGS. 6–11) which protrude from their top an bottom truss chords 26,28. Gaps at adjoining ends and sides of modules are closed by filler strips 54.

As a result of this combining of modules, three auger strings of equal length (e.g., 40') are situated parallel to each other and oriented laterally of, and perpendicular to, the bridge. The end-to-end connection 70 for two augers 44 is illustrated in FIG. 15, with area of connection being fully enclosed by shroud 72 so as to isolate the auger from the environment outside of the enclosure.

The platform assembly includes an enclosure which serves to visually define boundaries of the work platform and to prevent toxic dust and particulates resulting from the blasting process from contaminating or otherwise affecting the environment.

At opposite ends of the composite platform assembly are end frames 122,123 having two wing frames 130 pivotally hinged to each end frame. A doorway 124 is provided in end frame 122, and windows 126 are provided in end frame 123. Windows 126 have self-closing louvers which open in a manner yet to be described. The skeletal frames of ends 122,123 and wing 130 are aluminum conduit or the like tubular material. The horizontal portions of wing frames 130 may be telescopically adjustable in order to accommodate lateral variations between the outside of an I-beam 8 and the corresponding end frame 122 or 123.

A prototype of the invention has tubular hose attached along the top of the frames so as to provide compressible seals 136. The prototype also has height-adjusting feet 120, much like the threaded height adjusting feet typically used in tubular construction scaffolding. By adjusting feet 120, the height of the frames are raised or lowered so as to engage or disengage seals 136 with the bridge deck underside which extends out past I-beam 8.

Figure 1A:
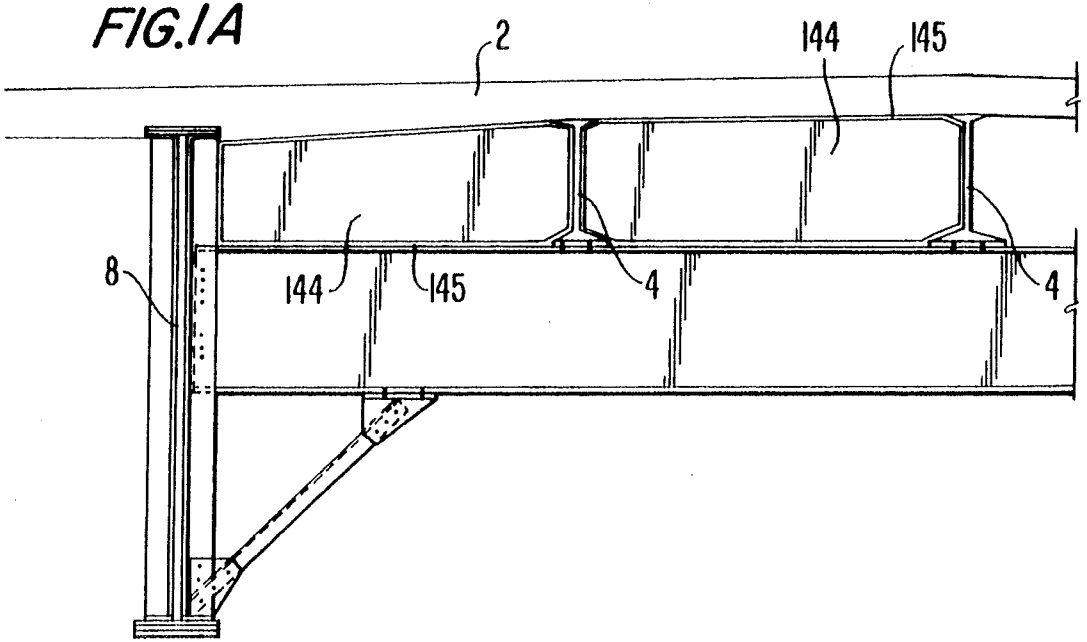
FIG. 1A is a partial, sectional view depicting special enclosure panels.
Figure 22:
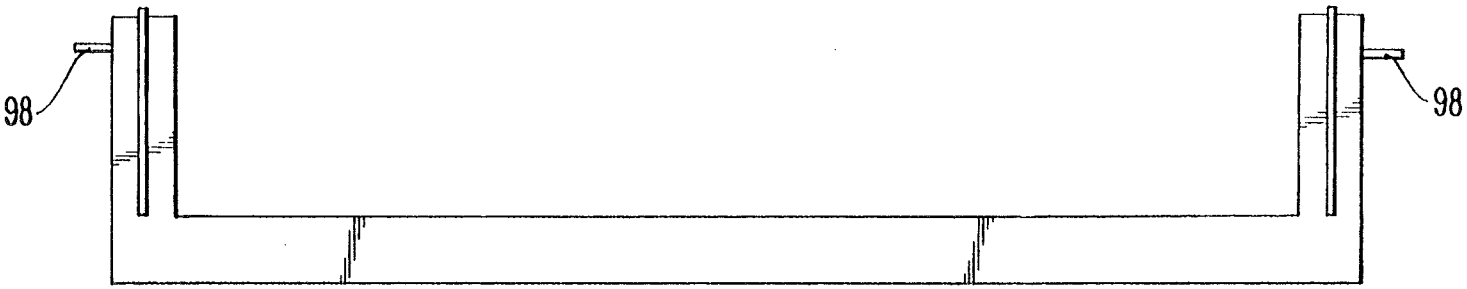
FIG. 22 is a partial bottom plan view of FIG. 18.

A curtain 140, which is appropriately impervious and preferably translucent, is attached to the tubular framing to form part of the enclosure. The enclosure also includes side curtains 138 along the length of the platform assembly, as seen in FIG. 1, which are raised and attached to I-beams 4 and 8 by appropriate C-clamps 142 or the like after raising the suspended platform into position for treatment of the I-beams. Closures are specifically sized and/or adjustable to finish enclosure of the areas above curtains 138 and between the I-beams. For example, FIG. 1A illustrates the use of custom-made plywood panels 144, each being of sized slightly under the area it closes and having a pliable material 145 along its edges. The pliable material 145 provides a good seal when the tight fitting panels are "wedged" into place during use. Although not shown, the closures also may be adjustable, telescoping frames with material draped thereover or attached thereto.

With reference to FIGS. 1, each string of interconnected augers 44, resulting from end-to-end connection of modules 10, is driven by a motor 46. One end of each module is adapted to removably receive the motor 46 and motor support shelf 56, in order that one motor 46 can drive the auger string. It is convenient, but not necessary, for motor 46 to be pneumatic.

Each module 10 also is capable of removably receiving an auxiliary platform assembly 68, also as seen in FIG. 1, for ease of access of workers to and from the enclosure of an assembled platform by ladder or otherwise.

Figure 14:
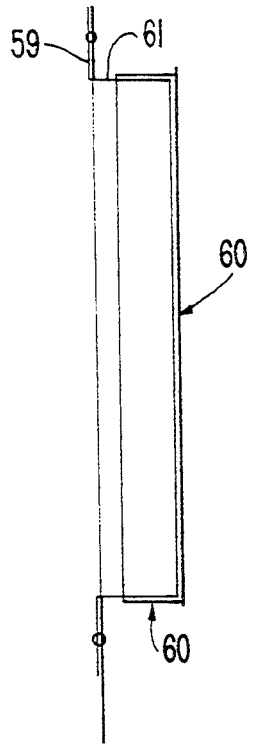
FIG. 14 is a partial, sectional view depicting the exhaust port and removable cover for one end of each of the modules.

Referring to FIG. 14, one end of each module 10 also has an exhaust port 58 with a closure 60 which is removable and replaceable as required in assembling the platform assembly. The port 58 is positioned in the end of the trough of each module, below grating 50 and above auger 44. The assembled platform may have an elbow 62 attached to an open port 58 on the end of each series of modules 10, as seen in FIGS. 1 and 3–5. Elbows 62 facilitate connection of large vacuum hoses for exhausting airborne particles and dust from the enclosure, as will be explained in more detail in the following.

Also, as seen in FIGS. 1 and 3–5, an elbow 66 is attached to at the end of series of module troughs so as to receive the particulate material exiting from a string of augers 44. Conduit or the like (not shown) is attached to each of the elbows 66, and vacuum or some other means of conveyance may be utilized to further evacuate the blasting particulates that are recovered and moved out of the module troughs via augers 44.

Another particular feature of the invention is that the grates 50 are removable to allow access to the auger 44 from the inside of the trough for maintenance or repair purposes as needed. For instance, it is contemplated that the auger 44 of each module 10 may be made up of at least two end-to-end sections so as to facilitate mounting and interchanging of augers 44 or auger sections from the inside of the trough of the module, as might be preferable or required when the platform is already assembled and/or suspended under a bridge.

Also, it is contemplated to provide means for monitoring the amount and/or weight of particulate blasting material entering and leaving the confines of the enclosed platform and halting the feeding of the blasting material upon detecting an unsafe imbalance therebetween, so that any slowing or halting of particulate material removal, and consequent overloading of the platform, can be avoided. Because of structural and safety considerations, it is particularly important to minimize weight acting on the suspended platform, as may occur from a blockage in the evacuation of particulate material from the platform assembly.

SUSPENSION SYSTEM

Figure 2:
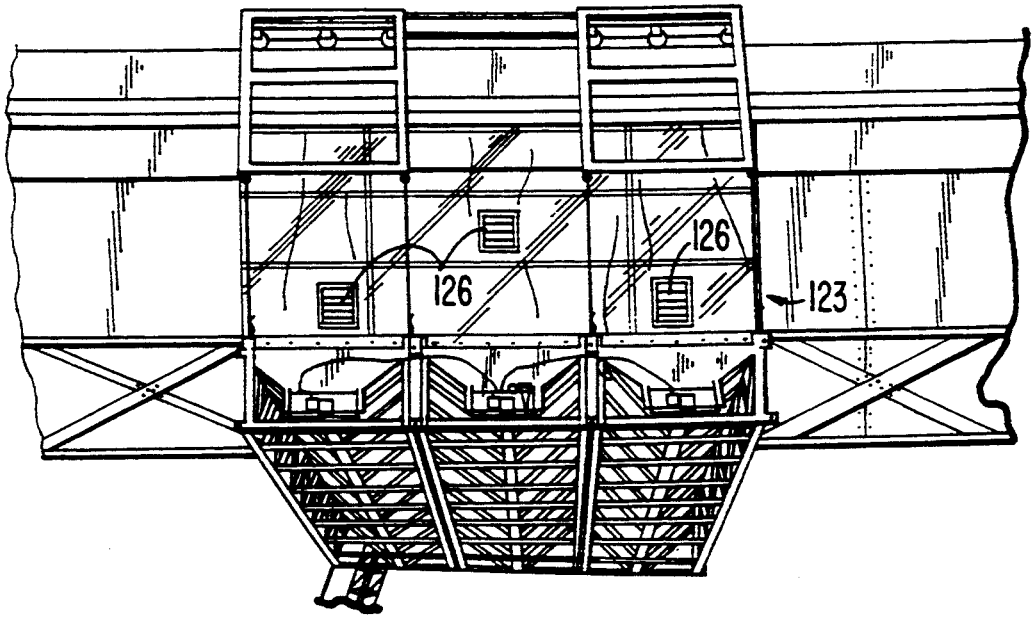
FIG. 2 is a perspective view of the left side of FIG. 1.
Figure 3:
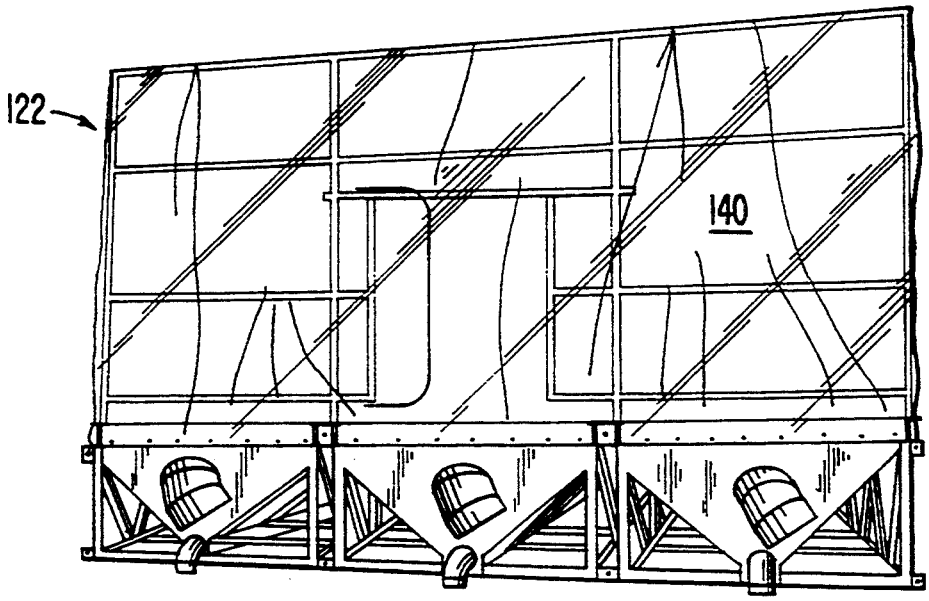
FIG. 3 is a perspective view of the right side of the platform assembly of FIG. 1 after it has been lowered to ground level.
Figure 5:
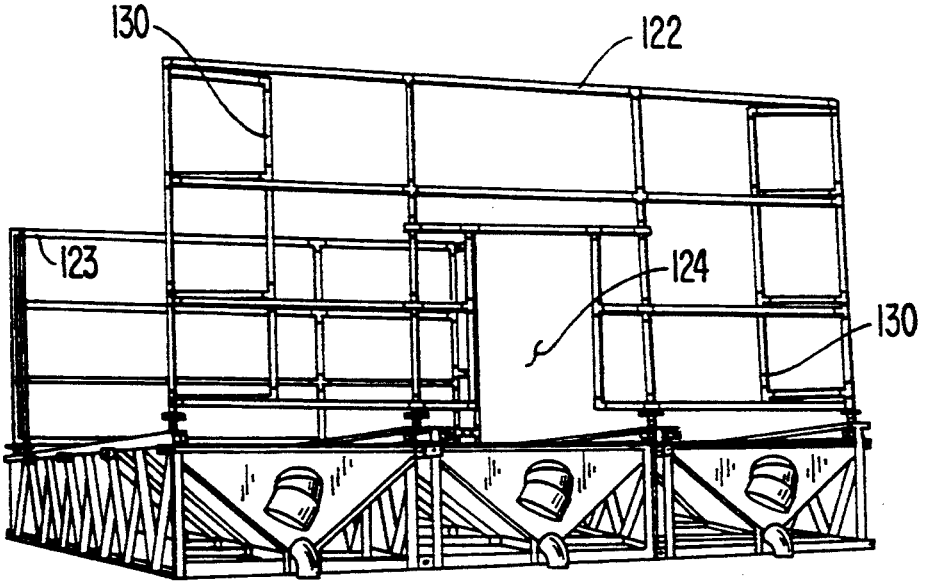
FIG. 5 is another perspective view of the platform assembly with all of the curtains removed.
Figure 4:
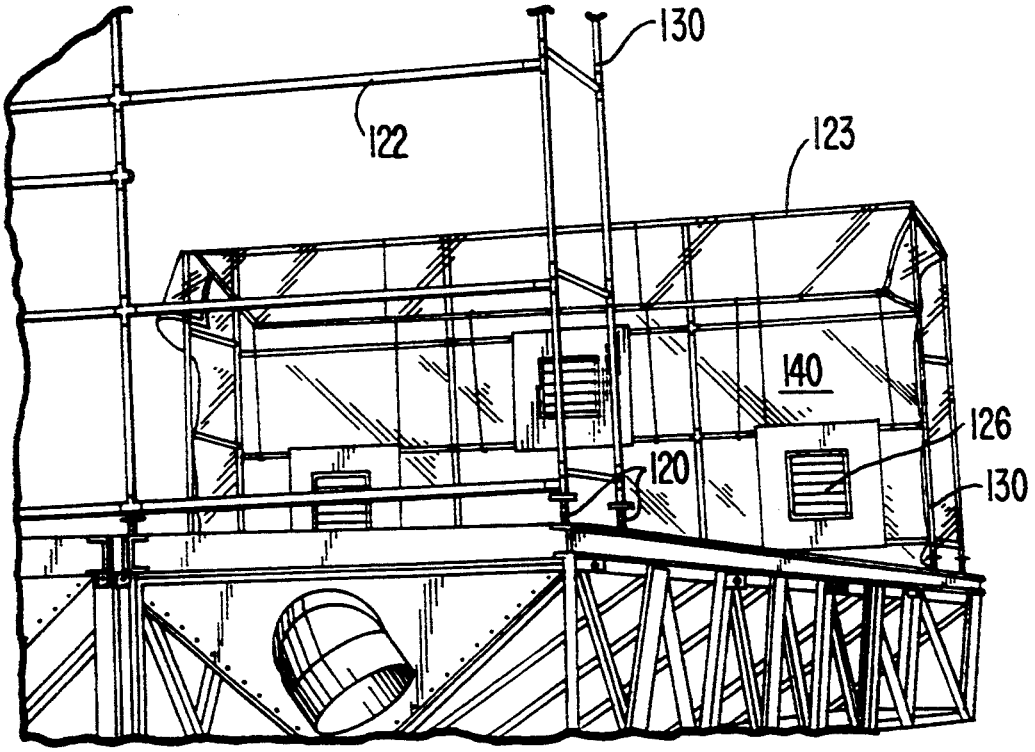
FIG. 4 is a perspective view similar to that of FIG. 3, but with the curtain removed from the nearest end wall frame.
Figure 7:
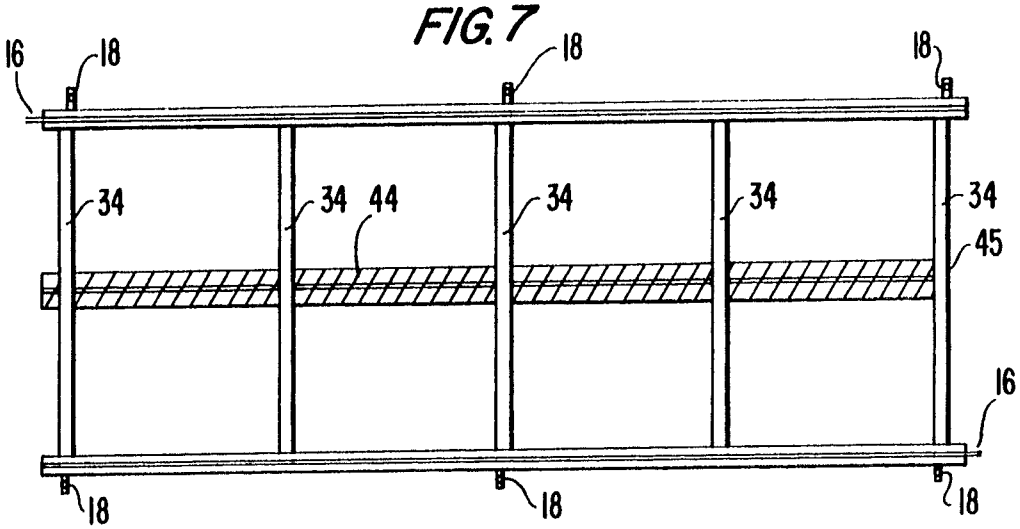
FIG. 7 is a top plan view of the module of FIG. 6 with the grating removed therefrom.
Figure 16:
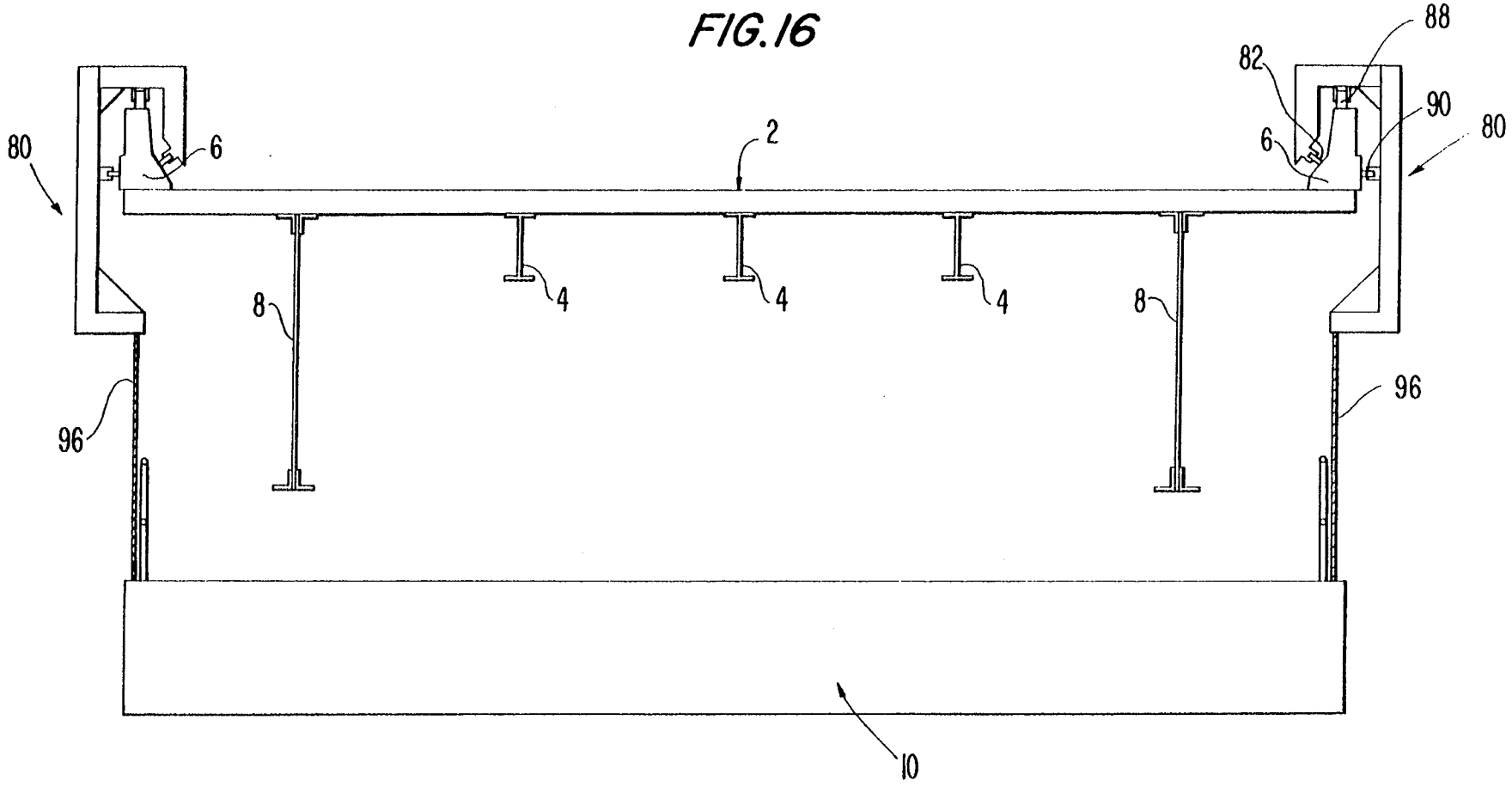
FIG. 16 is a view similar to FIG. 1, but with the details of the platform removed in order to better illustrate the rolling suspension frame for the platform.
Figure 17:
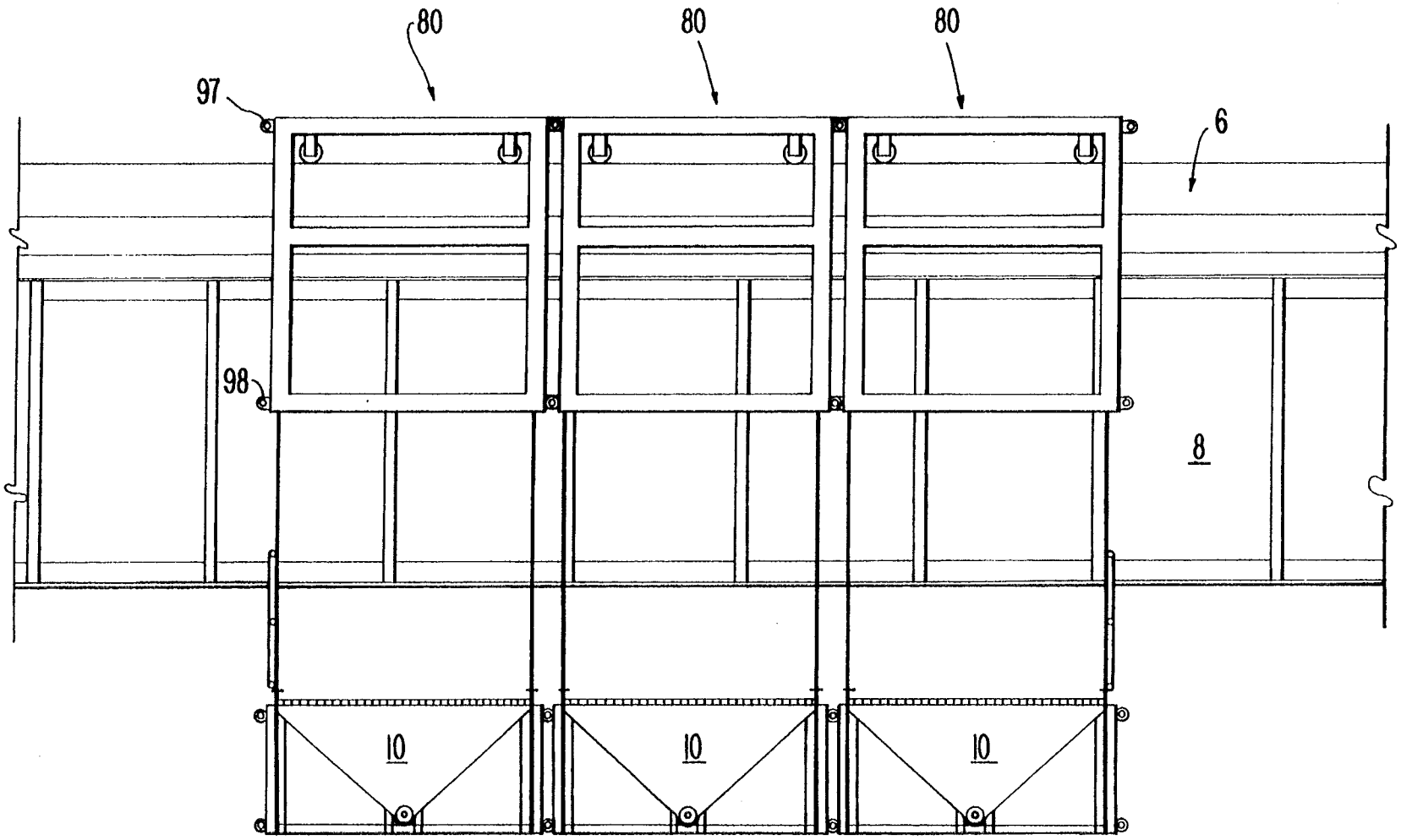
FIG. 17 is a right side elevation of the device of FIG. 16.

Suspension of a platform below the bridge is illustrated in FIGS. 16 and 17, in which frames 80 mount on, and are rollable along, Jersey wall-type parapets 6. Referring to FIG. 16, cables 96 suspend the platform 10 from each suspension frame 80, with cables 96 being coplanar with the line of travel of top wheels 88 so as to provide vertical loading of the platform suspension on parapets 6. Although not shown, winches may be provided on either of the suspension frame 80 or the platform 10 in order to raise and lower the platform relative to the bridge. As seen in FIG. 17, a series of suspension frames 80 may be attached together in the direction of the length of the bridge. Alternatively, the middle suspension frame for each end of the platform assembly may be replaced by linkage as illustrated in FIG. 2.

Figure 23:
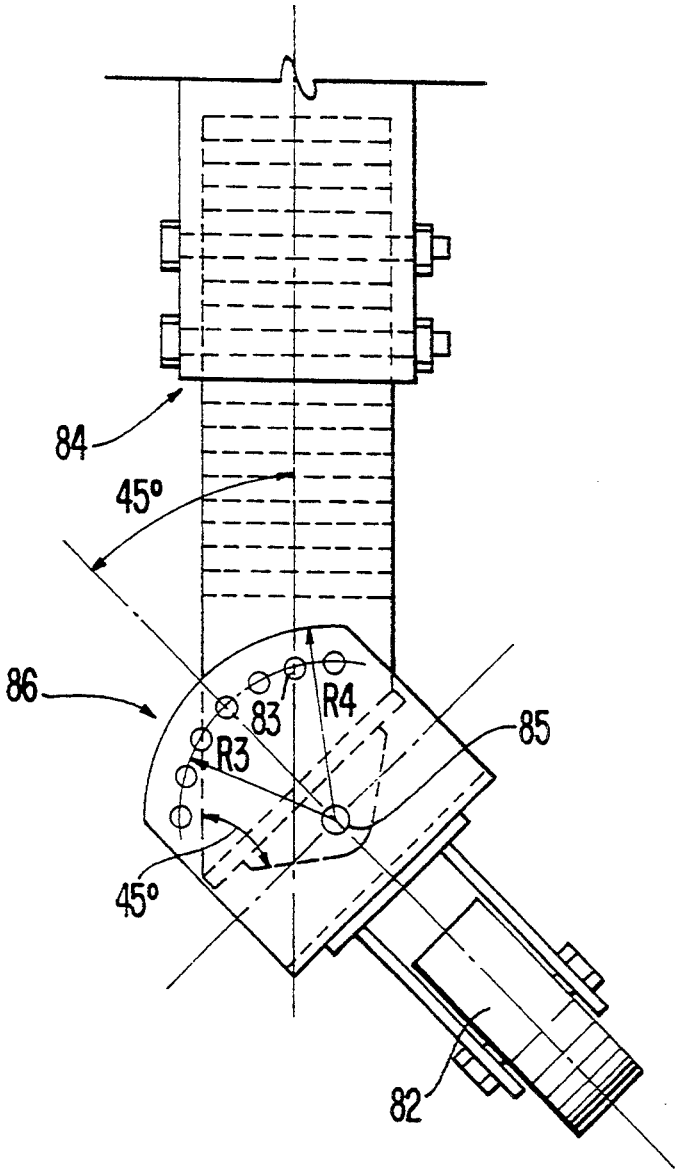
FIG. 23 is an enlarged fragmentary view of an adjustable portion of the suspension frame that provides for adjustment of the rollers to various parapet contours.

Referring to FIGS. 18–23, each suspension frame 80 has: (i) two or three top wheels 88 engagable with and ridable along the top surface of the parapet 6, (ii) outside wheels 90 engagable with the outside surface of the parapet 6, and (iii) inside wheels 82 which are adjustable, along with telescoping bracket 84, so as to conform the suspension frame 80 with the inner surface of the parapet 6. As seen in FIG. 23, bracket 86 provides support for roller 82 and is pivotally attached at 85 to the telescopic frame portion 84. Member 86 has a plurality of holes in a arcuate top portion thereof so that pin 83 may be used to retain the selected position of adjustment.

Figure 18:
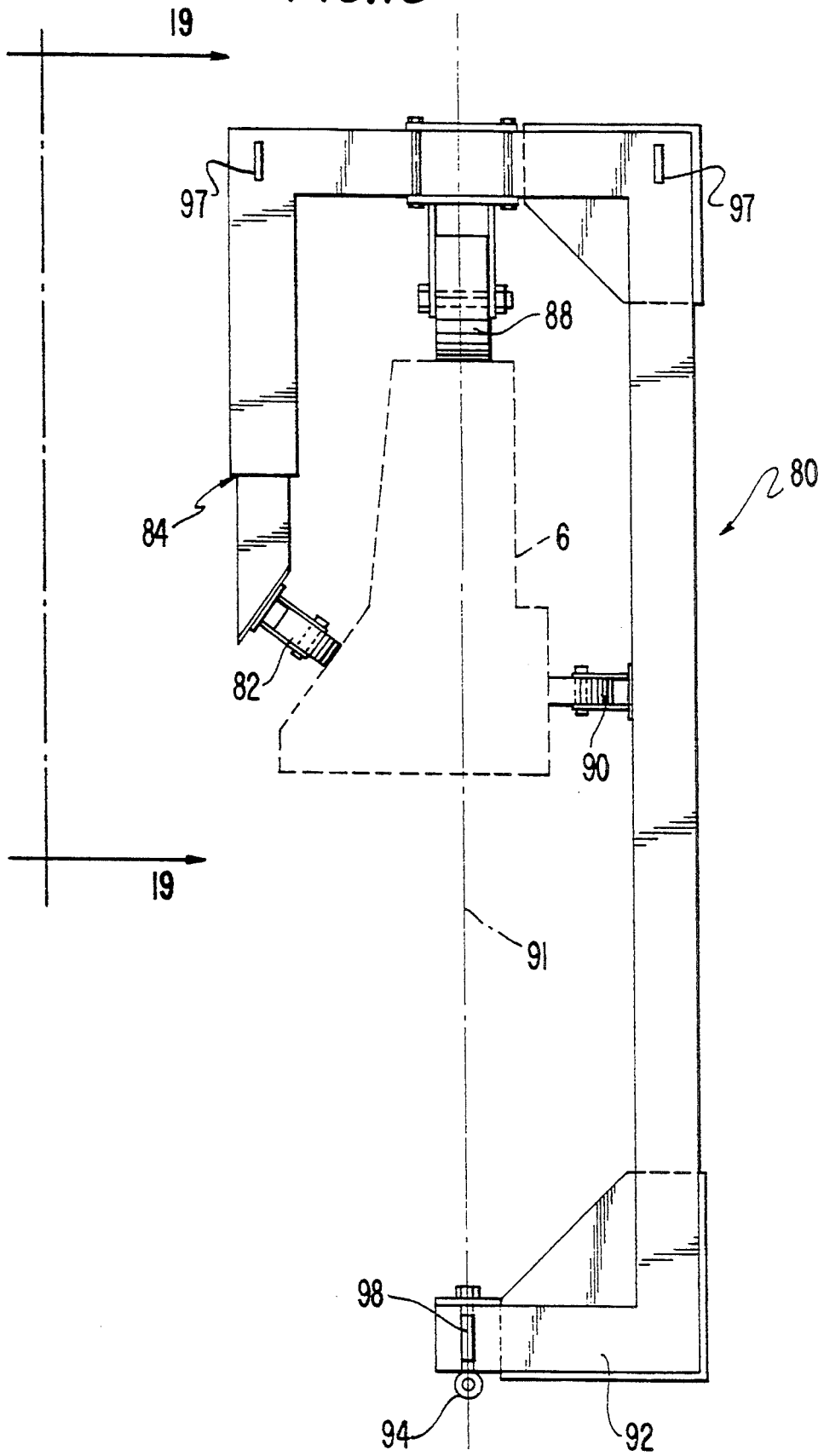
FIG. 18 is an enlarged view of the suspension frame without the platform attached.

The suspension frames 80 also have two side connecting ears 97 on each end of the frame at the top thereof, and side connecting ears 98 at each end thereof on the lower portion 92, and eye bolts 94 are provided on the distal end of lower portion 92. Referring to FIG. 18, a vertical plane 91 is viewed from one edge as passing through bolts 94 on each end of the suspension frame 80 and bisecting each of the top wheels 88 thereof so that suspension cables 96 (seen in FIGS. 16 and 17) also fall within plane 91 and provide stable, balanced support of frames 80 on the top surface of the parapets 6 for optimum transfer of support of the frames 80 vertically, through parapets 6 to the top surface of bridge deck 2.

Figure 19:
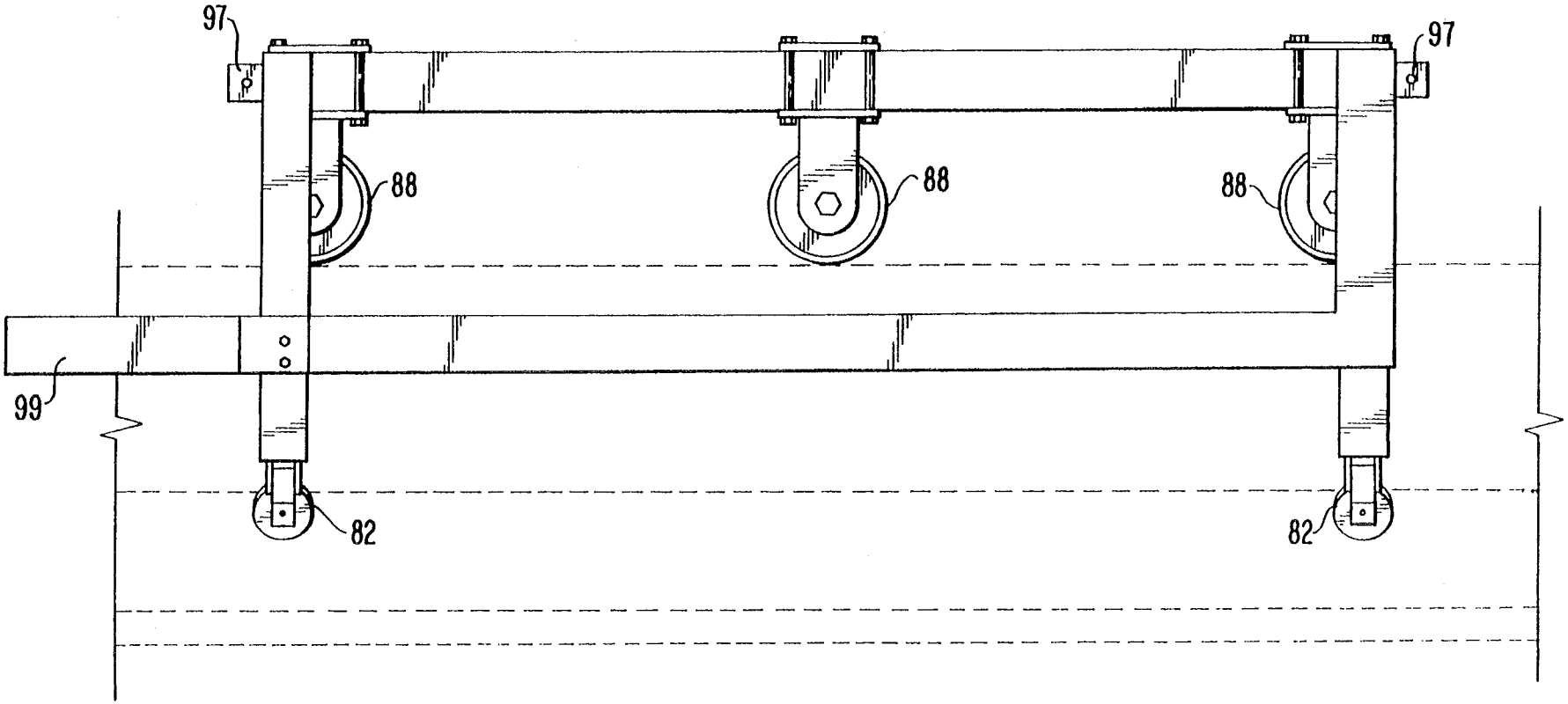
FIG. 19 is a left side elevation of FIG. 18, as viewed generally in the direction of arrows 19—19.
Figure 20:
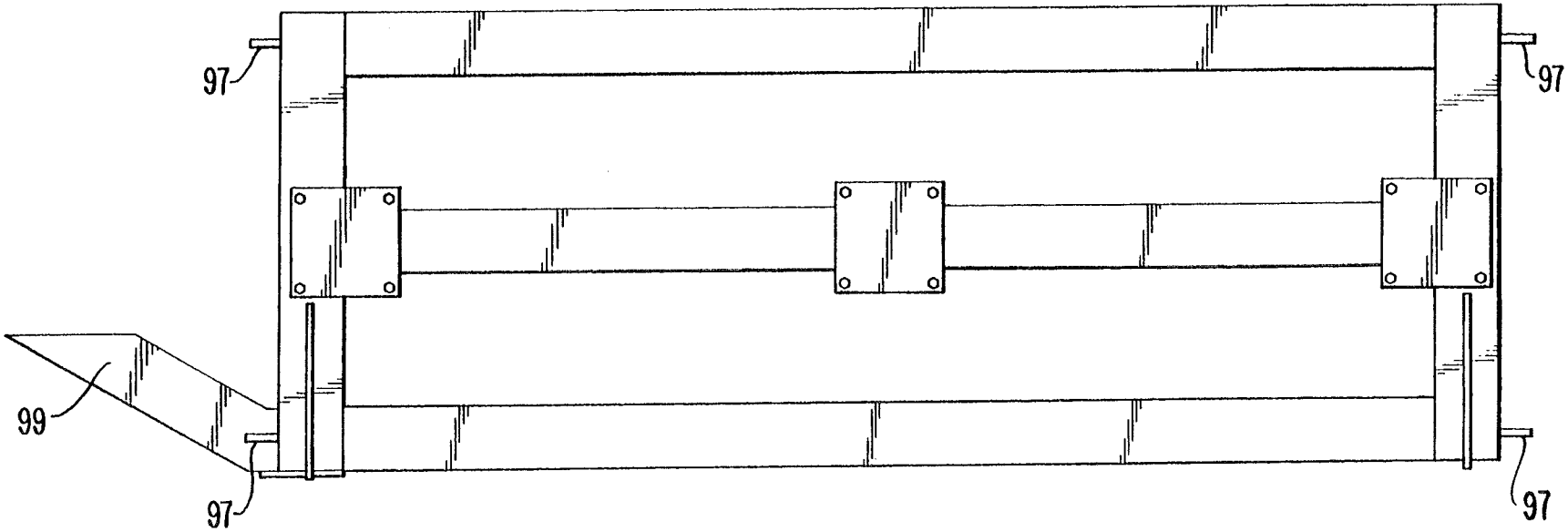
FIG. 20 is a top plan view of the rolling suspension frame.
Figure 21:
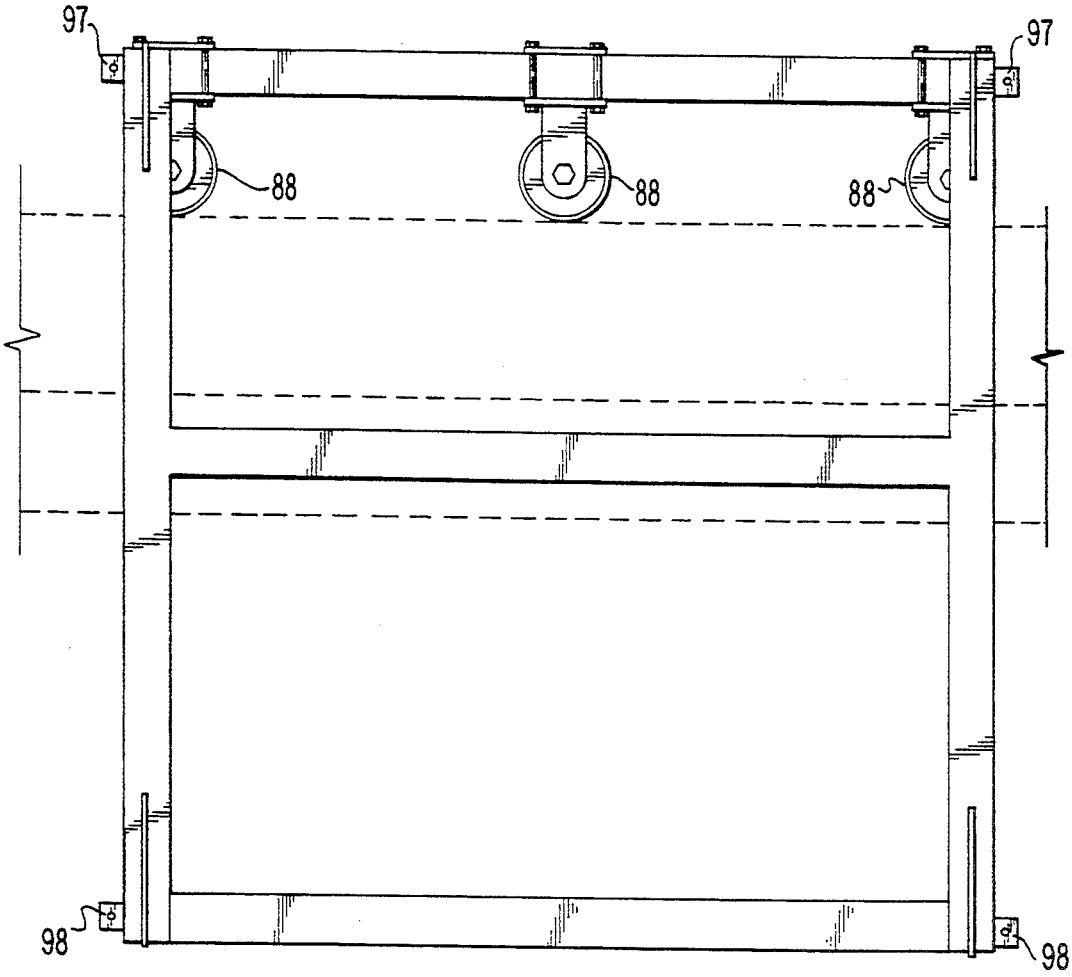
FIG. 21 is a right side elevation of FIG. 18.

As best seen in FIGS. 19 and 20, an angled bumper 99 is boltable to either end of suspension frame 80. as desired. The particular shape of bumper 99 has been chosen so that impact by a vehicle traveling on bridge decking 2 tends to drive bumper 99 into contact with, and transfer the force of impact to, the parapet 6 for absorption thereof, while deflecting the impacting vehicle away from the rest of the frame. The bumper 99 is provided for cases of incidental contact, rather than severe collisions, and is intended to allow the impacting vehicle to continue travel past the suspension frame 80 while minimizing further impact to the frame. It also is contemplated that bumper 99 may be wholly or partially composed of an impact absorption material such as rubber.

An alternate suspension frame 100 is provided for those situations wherein obstructions or discontinuities in the parapet structure, or a horizontal tubular railing attached to the top of the parapet 6, prevent rolling contact of the suspension frame along the surface of the parapet 6 in the manner illustrated in FIGS. 16–23.

In such cases, the alternate frame 100 may have adjustable top portions 102, 104, and 106 by which the alternate frame 100 may be clamped onto several points spaced along the solid portion of the parapet 6, with a rail 108 attached to the frame 100. Rollers 110 are rollable along the top surface of 108 with suspension arms 112 attached to the axles of rollers 110 and supporting eye bolts 114 which, in turn, support suspension cables 96.

The alternate frame 100 also provides that suspension cables 96 will be situated relative to parapet 6 and a plane (similar to plane 91 as described with reference to FIGS. 16–18).

Figure 24:
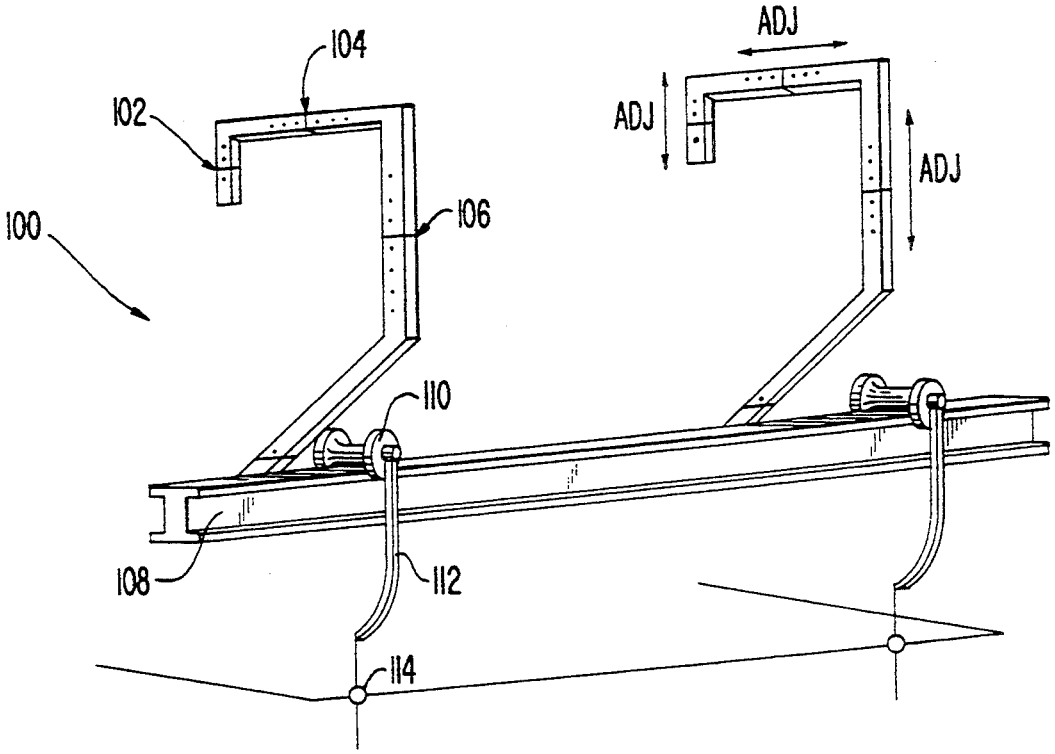
FIG. 24 is an isometric view of an alternate embodiment of the suspension frame.

Although not illustrated in FIG. 24, means can be provided for attaching several rails 108 end-to-end, much like the attachment of frames 100 together, as well as a means of stopping rollers 110 from rolling off of opposite ends of a connected string of such rails 108.

Once frames 102,104,106 are adjusted and attached to the sides of the bridge, the depending portion thereof allows movement of platform assembly 10 along the length of a bridge for step-by-step blasting and/or painting the surfaces of the metal structure supporting the bridge.

USE OF THE ENCLOSED PLATFORM

It is to be understood that the platform assembly 10 can be lifted by cranes or the like into position for attachment to fixed length cables 96 which depend from the rolling suspension frames 80 or, alternatively, lifting cables 96 can be attached to a winching mechanism by which the platform assembly 10 can be hoisted into position under the bridge. For either case, end frames 122 and 123 should be lowered vertically as much as possible by means of the adjustable feet 120. Thus, upon raising the platform 10 to a height wherein the tops of frames 122 and 123 are within about 3" of the bottom surface of bridge deck 2, the feet 120 can be adjusted to raise frames 122 until they are sealed to the deck surface by compressible seals 136.

However, prior to adjusting feet 120 in order to raise the frames 122 and 123, the wing frames 130 are pivoted into engagement with the outer surface of outer I-beams 8 so that the wing frames 130 will ensure enclosure of that portion of frame 10 which extends outside of I-beams 8. Thereafter, the side curtains 138, which are suitably attached at their bottoms to platform 10, are raised into engagement with the bottom of each of the I-bars 4 and 8 and clamped thereto by C-clamps 142 or the like. The remaining unenclosed areas between the I-beams are then closed by the above-described special fillers. Thus, a totally enclosed work platform is provided for treatment of the surfaces of the I-bars which are inside of the enclosure. In particular, it is required that peeling surface coatings and rust be removed from the surfaces of these I-bars without contaminating the environment by the residue of lead-based paint previously used to coat the surfaces. Typically, such removal of surface coatings and rust is accomplished by blasting the surfaces with shot and/or abrasive grit projected under pressure onto the surfaces. Presently, the particular blasting material is recovered for reuse so as to be more economical. Thus, it is necessary to recover the contaminated, spent particulate material used in blasting as well as the airborne residue resulting from the blasting operation and heavier residue which may not remain airborne.

Workers standing on the grating 50 of the platform assembly are free to move around and direct the blasting equipment onto the various surfaces within the enclosure and these workers are equipped with masks and any other apparel necessary for their environmental safety during such an operation. Additionally, a vacuum is pulled on the exhaust duct 58 via elbow 62 and the conduit attached thereto so as to draw sufficient air to open the self closing louvers of the windows 126 so as to pull air through the windows and the enclosure for removal of airborne dust particles and the like from the enclosure via the exhaust duct 58.

The heavier residue and the abrasive grit used during the blasting process fall down through grating 50 into the troughs so as to be directed down to the augers 44 for evacuation of these heavier materials off of the platform assembly. Although the end-to-end connection of an auger string provides for evacuation of heavier material along the full length of a series of end-to-end modules, the troughs of such end-to-end modules do not otherwise communicate with each other. Thus, the airborne residue does not travel the full length of several end-to-end connected modules prior to evacuation through exhaust port 58. Rather, as illustrated by flow path 152 in FIG. 1, the air currents by which airborne material is removed from the enclosure tends to separate all such airborne material prior to it being collected in the trough of module 10a. Thus, there is less mixing of airborne residue in with the abrasive particulate material which is to be reconditioned for reuse.

It is also contemplated that a movable or removable auxiliary panel 64 (indicated in phantom in FIG. 1 near the right end of module 10*b*) may be utilized to direct the flow path for airborne material along the upper path 150 so as to improve separation of the airborne particles from the heavier particles by directing the flow path for the airborne particles along a path which is above the majority of the length of the troughs in which the heavier particles are collected.

I claim:

1. A work platform assembly positionable at and spanning an underside of a structure so as to provide support for worker access to and treatment of surfaces of the structure, and comprising:

at least one module having:

trough means extending longitudinally of said module for collecting particulate material at a bottom thereof, said trough means including a trough outlet permitting the discharge of said particulate material therefrom;

removable grating positioned atop said trough means for supporting said worker thereon and allowing particulate material to pass therethrough into said trough means; and a conveyor at least partially located within said trough means, said conveyor including at least one movable member which physically contacts and conveys said particulate material to, and discharges said particulate material from, said trough outlet, said conveyor being accessible from inside of said trough means by said worker removing said grating and descending into said trough means.

2. A platform assembly as in claim 1, wherein said treatment comprises projecting abrasive particles onto said surfaces in order to remove material therefrom, said treatment also resulting in loose, spent abrasive particles and residue, and further comprising:

enclosure means, covering areas between said platform assembly and said surfaces of the structure, for blocking said spent abrasive particles and residue from a surrounding environment outside of said platform assembly.

3. A platform assembly as in claim 2, and said enclosure means further comprising:

curtains; and a frame assembly means, attached to said platform assembly, for supporting at least a portion of said curtains.

4. A platform assembly as in claim 3, and said frame assembly means comprising:

an end frame protruding from each end of said platform assembly, each said end extending sufficiently outwardly past an outermost portion of the structure so that an outer surface thereof is accessible by a worker standing on said grating and situated between said end frame and said outermost portion; and a wing frame pivotally attached to each end of each said end frame for pivotal engagement with said outermost portion;

means for adjusting said frame assembly means to profiles of said structure.

5. A platform assembly as in claim 3, and further comprising:

means for raising a top of said frame assembly means for engagement with an underside of said structure; and seal means, extending along said top of said frame assembly, for sealing said enclosure means to said underside of said structure.

6. A platform assembly as in claim 4, and further comprising:

side curtains extending along each side of said platform assembly between corresponding said wing frames; and means for attaching said side curtains to said structure.

7. A platform assembly as in claim 2, wherein said structure is a bridge, and further comprising means for suspending said platform assembly from each longitudinal side of said bridge, said platform assembly suspending means comprising:

a suspension frame assembly which is rollingly repositionable along a parapet of said bridge;

cables extending between said suspending means and said platform assembly for attachment thereof;

means for adjusting each said suspension frame assembly to a profile of said parapet for rolling engagement along a generally flat top of said parapet; and said cable substantially extending in a plane generally centered upon and extending vertically below said flat top of said parapet so as to transfer substantially all loading on said platform assembly vertically onto said flat top of said parapet.

8. A platform assembly as in claim 2, and further comprising:

a frame of said module, with sides of said trough means attached to and supported by said frame;

said sides of said trough means being translucent; and light sources mounted on said frame outside of said enclosure means and directed to transmit light into said enclosure means through said trough sides in order to illuminate said surfaces for work thereon.

9. A platform assembly as in claim 2, and said platform assembly further comprising:

inlet means for introducing air into said platform assembly from said outside environment;

an exhaust port; and exhaust means for applying vacuum through said exhaust port to said enclosure means and exhausting said air from said enclosure means so as to cause airborne portions of said residue to be entrained in an air current extending from said inlet means to said exhaust port.

10. A platform assembly as in claim 1, wherein said conveyor conveys said particulate material longitudinally along said trough means to said trough outlet.

11. A platform assembly as in claim 1, wherein said conveyor includes at least one auger positioned within said trough means, and a driving motor for rotating said auger.

12. A platform assembly as in claim 1, wherein trough means has an open upper end, a length in the direction extending longitudinally of said module, and a width in the direction extending laterally of said module, said removable grating positioned atop and covering substantially the entire length and width of trough means.

13. A work platform assembly positionable at and spanning an underside of a structure so as to provide support for worker access to and treatment of surfaces of said structure by directing abrasive particles projected onto said surfaces in order to remove material therefrom, said treatment also resulting in loose, spent abrasive particles and residue, and comprising:

at least first and second modules, said first and second modules being connected together, each said first and second module comprising:

a frame comprising side trusses extending longitudinally of said module, and lateral beams connecting said side trusses together, said side trusses each having a top chord and a bottom chord, and said chords being formed to be cambered when unloaded and straightened when sufficiently loaded, end means for connecting said modules together end-to-end by connecting corresponding side trusses of said modules together end-to-end, said end means comprising connector receiving holes sufficiently sized to accommodate said connecting in loaded and unloaded states of said modules, a trough attached to said frame and extending longitudinally of said module, for collecting particulate material at a bottom thereof, worker supporting structure positioned atop said trough for supporting a worker thereon, and a conveyor system for positively conveying said particulate material to, and discharging said particulate material from, an end of said trough; and enclosure means, covering areas between said platform assembly and said structure, for blocking said spent abrasive particles and residue from a surrounding environment outside of said platform assembly;

said conveyor system of said first module conveying said particulate material to, and discharging said particulate material from, said end of said trough of said first module into said trough of said second module, and said conveyor system of said second module conveying said particulate material to, and discharging said particulate material from, said end of said trough of said second module for discharge from said platform assembly.

14. A platform assembly as in claim 13, and said platform assembly further comprising:

inlet means for introducing air into said enclosure means from said outside environment;

an exhaust port, in one end of one of said modules, adapted for applying vacuum therethrough to said enclosure means and exhausting said air therefrom so as to cause airborne portions of said residue to be entrained in an air current flowing from said air inlet means to said exhaust port; and a removable closure by which said exhaust port can be opened and closed.

15. A platform assembly as in claim 14, and further comprising:

each said trough being closed at each end by end walls; and said bottom of each said end-to-end module having housing means for connecting said conveying systems end-to-end through said end walls such that said particulate material in said trough is conveyable lengthwise of said platform assembly and dischargeable at a discharge outlet.

16. A platform assembly as in claim 15, wherein said worker supporting structure is grating, and said work platform assembly further comprising means for limiting collection of said airborne residue portions by said connected conveyor systems:

said exhaust port being situated in one of said trough end walls of a module, above said conveyor system and below said grating, at one end of said platform assembly;

said inlet means being situated above said grating at an opposite end of said platform assembly from said inlet means, whereby a said air current entrains said airborne residue portions prior to said portions passing through said grating of all but said module on one end of said platform assembly.

17. A platform assembly as in claim 16, and further comprising:

an auxiliary trough wall, situated near said exhaust port in said module on one end of said platform assembly, for further limiting an area of said grating thereof through which said air flow path is directed.

18. A platform assembly as in claim 13, wherein said conveyor systems of each said first and second module include an auger.

19. A platform assembly as in claim 18, wherein said augers of said first and second modules are coupled to one another such that the rotation of the auger in the first module causes rotation of the auger in the second module.

20. A platform assembly as in claim 13, wherein said worker supporting structure includes grating allowing particulate material to pass therethrough into said trough, said conveyor systems convey fallen particulate material for discharging airborne particulate material from the connected modules, said platform assembly further including an exhaust port and vacuum means for discharging airborne particulate material from the connected modules.

21. A platform assembly as in claim 13, said worker supporting structure is grating allowing particulate material to pass therethrough into said trough, wherein said grating positioned atop said trough is removable, said conveyor system being accessible from inside of said trough by a worker upon removing said grating and descending into said trough.

22. A work platform assembly positionable at and spanning an underside of a structure so as to provide support for worker access to and treatment of surfaces of the structure, wherein said treatment comprises projecting abrasive particles onto said surfaces in order to remove material therefrom, said treatment also resulting in loose, spent abrasive particles and residue, said work platform assembly comprising:

at least one module having a trough extending longitudinally of said module for collecting particulate material at a bottom thereof, and worker supporting structure for supporting a worker in said module;

an enclosure covering areas between said platform assembly and said structure, said enclosure blocking said spent abrasive particles and residue from a surrounding environment outside of said platform assembly;

a vacuum conveyor for conveying said particulate material from said enclosure;

inlet means for introducing air into said enclosure from said surrounding environment;

said vacuum conveyor including an exhaust port, and an exhaust means for applying a vacuum through said exhaust port to said enclosure and exhausting said air from said enclosure so as to cause airborne portions of said residue to be entrained in an air current extending from said inlet means to said exhaust port;

said inlet means includes pivotal louvers which are pivoted open by application of a vacuum to said enclosure by said exhaust means and self-closing upon a vacuum not being applied thereto by said exhaust means.

23. A platform assembly as in claim 22, wherein said exhaust port is located at one end of said enclosure and said pivotal louvers are located at the opposite end of said enclosure.

24. A platform assembly as in claim 23, wherein said exhaust port is located at one end of said trough.

25. A platform assembly as in claim 22, wherein trough has an open upper end, a length in the direction extending longitudinally of said module, and a width in the direction extending laterally of said module, said worker supporting structure including grating positioned atop said trough for supporting a worker thereon and allowing particulate material to pass therethrough into said trough, said grating positioned covering substantially the entire length and width of said trough.

26. A platform assembly as in claim 25 wherein said grating is removable to permit a worker to access and descend into said trough.

27. A work platform assembly positionable at and spanning an underside of a structure so as to provide support for worker access to and treatment of surfaces of said structure, wherein said treatment comprises projecting abrasive particles onto said surfaces in order to remove material therefrom, said treatment also resulting in loose, spent abrasive particles and residue, said work platform assembly comprising at least one module having:

a trough extending longitudinally of said module for collecting particulate material at a bottom thereof, worker supporting structure positioned atop said trough for supporting a worker thereon; and a conveyor for positively conveying said particulate material to, and discharging said particulate material from, an end of said trough, said conveyor comprises at least one auger within said trough, and means for driving said auger, said means for driving said auger comprising an auger driving motor situated outside of said trough, said auger being accessible from inside of said trough by said worker removing said grating and descending into said trough.

28. A platform assembly as in claim 27, wherein trough has an open upper end, a length in the direction extending longitudinally of said module, and a width in the direction extending laterally of said module, said worker supporting structure including removable grating positioned atop and covering substantially the entire length and width of said trough, said removable grating allowing particulate material to pass therethrough into said trough.

29. A platform assembly as in claim 27, further comprising enclosure means covering areas between said platform assembly and said structure, for blocking said spent abrasive particles and residue from a surrounding environment outside of said platform assembly.

30. A work platform assembly positionable at and spanning an underside of a structure so as to provide support for worker access to and treatment of surfaces of said structure, and comprising:

at least one module having:

a trough extending longitudinally of said module for collecting particulate material at a bottom thereof, a first outlet for permitting the discharge of particulate material therefrom, said first outlet positioned in said trough;

a second outlet for permitting the discharge of particulate material therefrom, said second outlet being located vertically above said first outlet;

worker supporting structure positioned atop said trough for supporting said worker thereon;

a first conveyor, said first conveyor including at least one movable member which physically contacts and conveys said particulate material to, and discharges said particulate material from, said first outlet; and a second conveyor, separate from said first conveyor, for discharging said particulate material from said second outlet.

31. A platform assembly as in claim 30, wherein said worker supporting structure is removable grating allowing particulate material to pass therethrough into said trough, said first conveyor being accessible from inside of said trough by a worker removing said grating and descending into said trough.

32. A platform assembly as in claim 30, wherein said first conveyor includes an auger and drive means for rotating the auger.

33. A platform assembly as in claim 30, wherein said first outlet is located at a longitudinal end of said trough, and said second outlet is located at a longitudinal end of said module.

34. A platform assembly as in claim 33, wherein said first and second outlets are located at the same longitudinal end of the module.

35. A platform assembly as in claim 30, wherein said first conveyor includes a mechanical conveyor for conveying fallen particulate material from said module, and said second conveyor including a vacuum conveyor for discharging airborne material from said module.

* * * * *